US010209645B2

(12) United States Patent
Tsuchiya et al.

(10) Patent No.: US 10,209,645 B2
(45) Date of Patent: Feb. 19, 2019

(54) VERTICAL BIAXIAL DEVELOPING DEVICE AND IMAGE FORMING APPARATUS AND PROCESS CARTRIDGE INCORPORATING SAME

(71) Applicants: Yuuki Tsuchiya, Tokyo (JP); Masayuki Yamane, Kanagawa (JP); Keiichi Yoshida, Kanagawa (JP); Atsushi Kurokawa, Kanagawa (JP); Toshiki Hayashi, Kanagawa (JP); Tatsuya Ohhira, Kanagawa (JP)

(72) Inventors: Yuuki Tsuchiya, Tokyo (JP); Masayuki Yamane, Kanagawa (JP); Keiichi Yoshida, Kanagawa (JP); Atsushi Kurokawa, Kanagawa (JP); Toshiki Hayashi, Kanagawa (JP); Tatsuya Ohhira, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/696,237

(22) Filed: Sep. 6, 2017

(65) Prior Publication Data

US 2018/0136586 A1 May 17, 2018

(30) Foreign Application Priority Data

Nov. 16, 2016 (JP) ..... 2016-223235

(51) Int. Cl.
*G03G 15/08* (2006.01)
*G03G 21/16* (2006.01)

(52) U.S. Cl.
CPC ..... *G03G 15/0893* (2013.01); *G03G 15/0881* (2013.01); *G03G 15/0898* (2013.01); *G03G 21/1647* (2013.01); *G03G 2215/0838* (2013.01)

(58) Field of Classification Search
CPC ..... G03G 15/0891; G03G 15/0893; G03G 15/0817; G03G 15/0898; G03G 2215/0838
(Continued)

(56) References Cited

U.S. PATENT DOCUMENTS 6,295,425 B1 * 9/2001 Garcia ..... G03G 15/0822 399/103
7,499,662 B2 * 3/2009 Fuwazaki ..... G03G 15/0817 399/103
(Continued)

FOREIGN PATENT DOCUMENTS

JP 02248974 A * 10/1990
JP 2013025145 A * 2/2013
(Continued)

*Primary Examiner* — Robert Beatty
(74) *Attorney, Agent, or Firm* — Harness, Dickey & Pierce, P.L.C.

(57) ABSTRACT

A developing device includes a casing to contain developer, a developer bearer, an upper and lower developer conveyors to convey the developer to one side in an axial direction of rotation shafts thereof, a communicating portion disposed on a first end side on which an input gear is disposed, to fall the developer from the upper developer conveyor to the lower developer conveyor, bearings to receive end portions the upper and lower developer conveyors, and first and second end seals to seal gaps in the bearings on the upper and lower developer conveyors, respectively. The first end seals and the second end are disposed on the first end side and a second end side, respectively. A sliding friction between the rotation shaft and at least one of the first end seals is smaller than a sliding friction between the rotation shaft and the second end seal.

11 Claims, 10 Drawing Sheets

(58) Field of Classification Search
USPC ..... 399/103, 105
See application file for complete search history.

(56) References Cited

U.S. PATENT DOCUMENTS

| | | | | |
|---|---|---|---|---|
| 2007/0071490 | A1* | 3/2007 | Nakaya | G03G 15/0817 399/103 |
| 2009/0041508 | A1* | 2/2009 | Oshikawa | G03G 15/0844 399/254 |
| 2010/0129110 | A1* | 5/2010 | Kawaguchi | G03G 15/0898 399/104 |
| 2013/0149009 | A1* | 6/2013 | Iwata | G03G 15/0836 399/254 |
| 2015/0093144 | A1* | 4/2015 | Sato | G03G 15/0817 399/103 |

FOREIGN PATENT DOCUMENTS

| | | | |
|---|---|---|---|
| JP | 2014-044321 | | 3/2014 |
| JP | 2014041208 | A * | 3/2014 |

* cited by examiner

A-A

VERTICAL BIAXIAL DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application No. 2016-223235, filed on Nov. 16, 2016, in the Japan Patent Office, the entire disclosure of which is hereby incorporated by reference herein.

BACKGROUND

Technical Field

This disclosure generally relates to a developing device, and a process cartridge and an image forming apparatus, such as a copier, a printer, a facsimile machine, or a multifunction peripheral (MIT) having at least two of copying, printing, facsimile transmission, plotting, and scanning capabilities, that include the developing device.

Description of the Related Art

There are developing devices that include a plurality of developer conveyors, such as a stirring screw and a supply screw, to convey developer in the axial direction of the developer conveyor. For example, the developer conveyors are arranged in a vertical direction (that is, disposed one above another).

The developer is sent down from the upper developer conveyor to the lower developer conveyor through a communication opening. The developing device further includes seals disposed at both ends of a rotation shaft of the developer conveyor to seal gaps between the rotation shaft and bearings supporting the rotation shaft.

SUMMARY

According to an embodiment of this disclosure, a developing device includes a casing to contain developer, a developer bearer to convey the developer to a developing range opposing an image bearer, and an upper developer conveyor and a lower developer conveyor disposed below the upper developer conveyor. Each of the upper developer conveyor and the lower developer conveyor has a rotation shaft and configured to convey the developer to one side in an axial direction of the rotation shaft. The developing device further includes an input gear disposed on a first end side of the developing device in the axial direction, to input a driving force to the developing device, a communicating portion disposed on the first end side, to fall the developer from the upper developer conveyor to the lower developer conveyor, bearings to receive end portions of the rotation shafts of the upper developer conveyor and the lower developer conveyor, and first end seals and second end seals to seal gaps in the bearings on the rotation shafts of the upper developer conveyor and the lower developer conveyor, respectively. The first end seals are disposed on the first end side, and the second end seals are disposed on a second end side of the developing device opposite the first end side. A sliding friction between the rotation shaft and at least one of the first end seals is smaller than a sliding friction between the rotation shaft and the second end seal.

According to another embodiment, a process cartridge to be removably mounted in an image forming apparatus includes the developing device described above and at least one of the image bearer to bear an electrostatic latent image developed by the developing device, a charger to charge the image bearer, and a cleaning device to clean the image bearer.

According to another embodiment, an image forming apparatus includes the image bearer to bear a latent image and the developing device described above.

According to another embodiment, an image forming apparatus includes the process cartridge described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
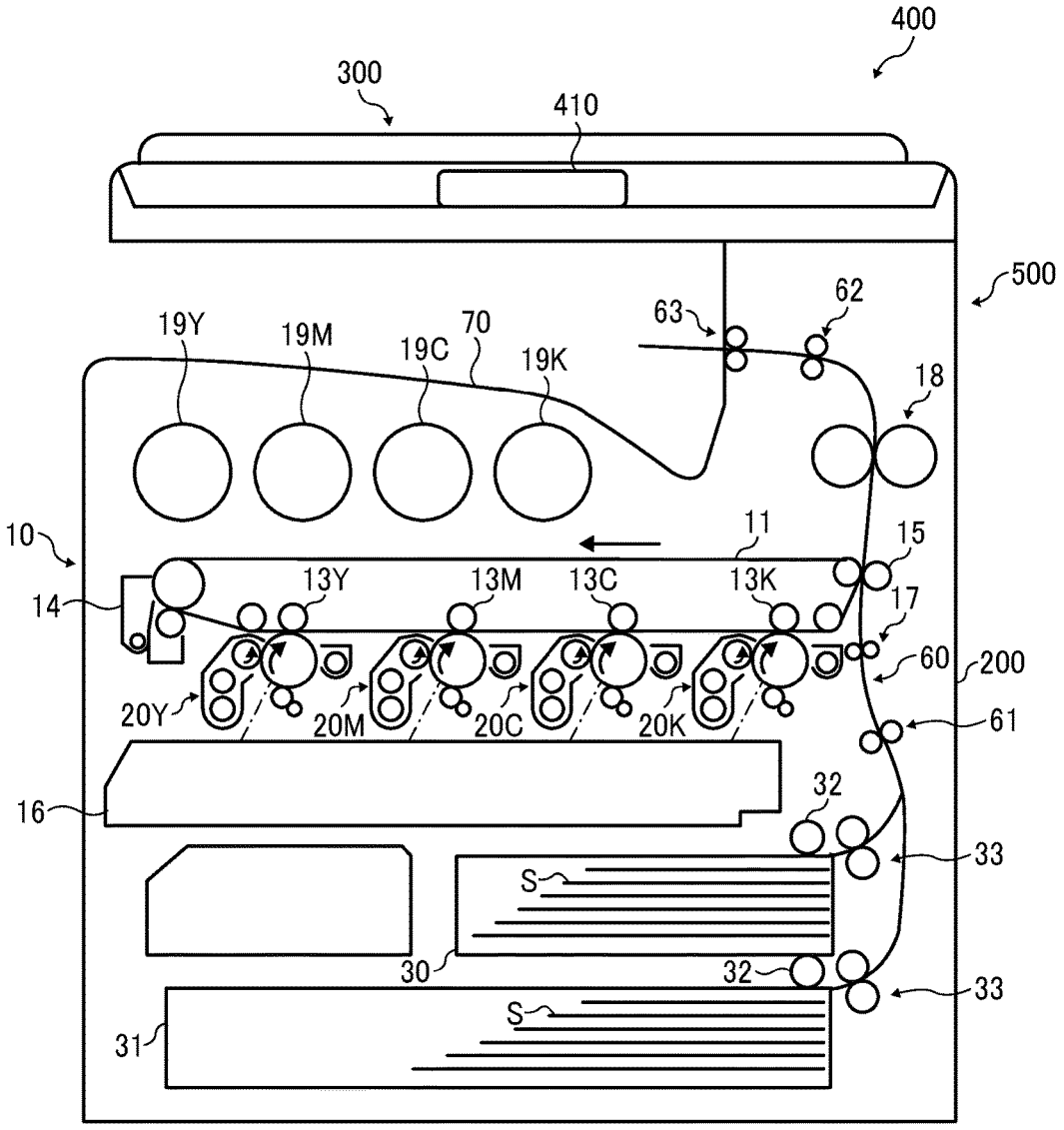
FIG. 1 is a schematic view of an image forming apparatus (e.g., MFP) according to an embodiment of this disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof and particularly to FIG. 1, an image forming apparatus according to an embodiment of this disclosure is described. As used herein, the singular forms "a", "an", and "the" are intended to include the plural forms as well, unless the context clearly indicates otherwise.

Descriptions are given below of, as an image forming apparatus according to this disclosure, an electrophotographic color image forming apparatus (hereinafter "image forming apparatus 500") to form a color image on a sheet S (a recording medium). For example, the image forming apparatus 500 is a multifunction peripheral (MFP). The sheet S includes a paper sheet, a coated paper sheet, a label sheet, a transparency such as an overhead projector (OHP) transparency, and film.

FIG. 1 is a schematic cross-sectional view of the image forming apparatus 500. The suffixes Y, M, C, and K attached to each reference numeral indicate only that components indicated thereby are used for forming yellow, magenta, cyan, and black images, respectively.

As illustrated in FIG. 1, on a body 200 of the image forming apparatus 500, a reading device 400 including a scanner 300 and an operation panel 410 is disposed. The body 200 contains an intermediate transfer device 10. The intermediate transfer device 10 includes an endless intermediate transfer belt 11 (i.e., an intermediate medium) entrained around a plurality of rollers and stretched almost horizontally. The intermediate transfer belt 11 rotates counterclockwise in FIG. 1. Below the intermediate transfer device 10, image forming devices 20Y, 20M, 20C, and 20K (collectively "image forming devices 20") are arranged side by side, in quadruple tandem, along the direction in which the intermediate transfer belt 11 extends. The image forming devices 20Y, 20M, 20C, and 20K form yellow, magenta, cyan, and black toner images, respectively.

Figure 2:
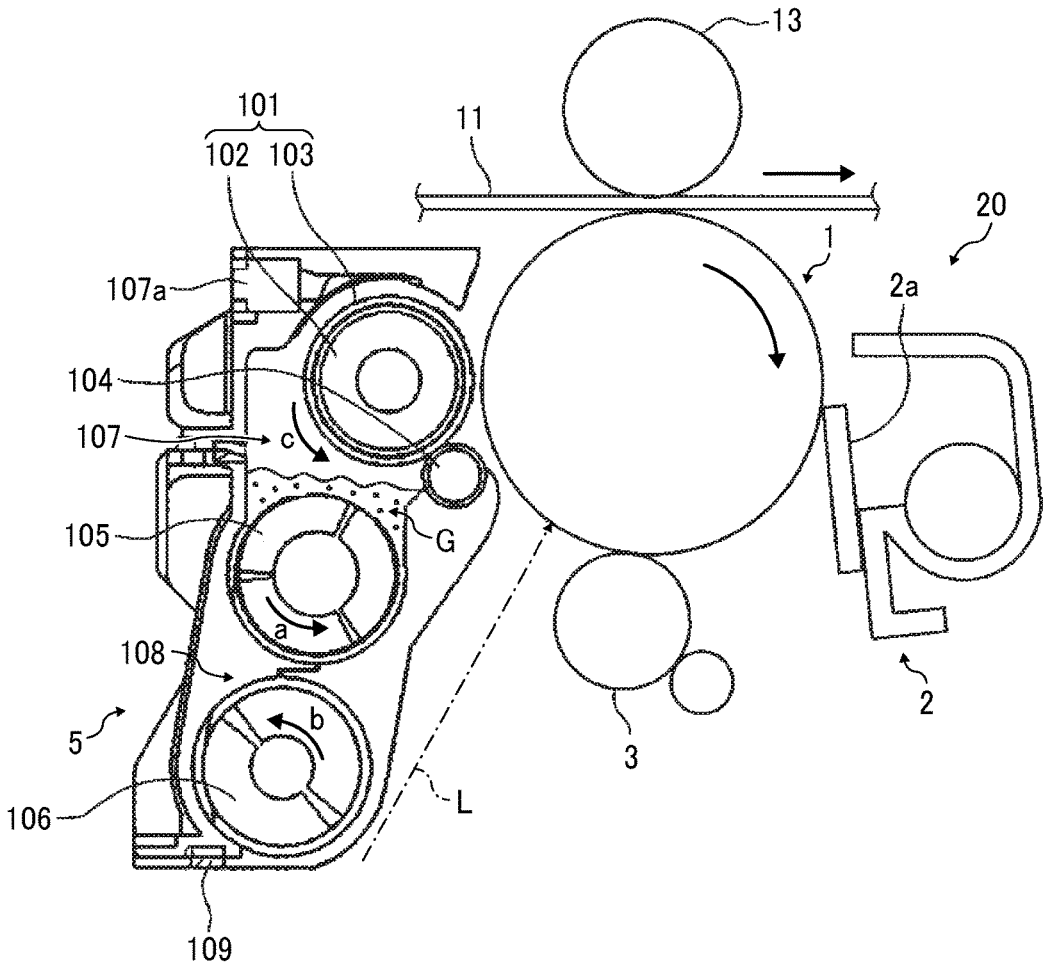
FIG. 2 is a schematic end-on axial view of an image forming device of the image forming apparatus illustrated in FIG. 1.

The image forming device 20 includes a drum-shaped photoconductor 1, serving as an image bearer and devices surrounding the photoconductor 1, namely, a charging device 3, a developing device 5, a primary transfer device 13 (13Y, 13M, 13C, or 13K in FIG. 1), and a photoconductor cleaning device 2 (illustrated in FIG. 2). The photoconductor 1 rotates clockwise in FIG. 1. An exposure device 16 is disposed below the image forming devices for writing electrostatic latent images. In the present embodiment, in the image forming device 20, the developing device 5 and at least one of the photoconductor 1, the charging device 3, and the photoconductor cleaning device 2 are housed in a common unit casing and united into a process cartridge that is removably installable in the body 200.

Below the exposure device 16, a first feeding tray 30 and a second feeding tray 31 to contain sheets S are disposed. From the first and second feeding trays 30 and 31, the sheet S is fed to a secondary transfer position of the intermediate transfer device 10.

By contrast, above the intermediate transfer device 10 and below a output stack section 70 on an upper side of the body 200, toner bottles 19 (Y, M, C, and K) to contain color toners supplied to the corresponding the developing devices 5 of the image forming devices 20 are disposed.

At the upper right of each of the first and second feeding trays 30 and 31 in FIG. 1, a feeding roller 32 to feed the sheet S on the top to a sheet conveyance path 60 and a conveyance roller pair 33 to convey the sheet S are disposed.

Most of the sheet conveyance path 60 is a vertical path extending from the lower right of the body 200 upward in FIG. 1 and leads to the output stack section 70 on the upper side of the body 200. In addition to the feeding rollers 32 and conveyance roller pairs 33 provided to the first and second feeding trays 30 and 31, the sheet conveyance path 60 is provided with a registration roller pair 17, a pre-registration conveyance roller pair 61 to feed the sheet S sent from the first feeding tray 30 or the second feeding tray 31 upward to the registration roller pair 17, and a secondary transfer device 15 disposed opposite the intermediate transfer belt 11. Further, along the sheet conveyance path 60, a fixing device 18, an ejection roller pair 63 to eject the sheet S onto the output stack section 70, and a post-fixing conveyance roller pair 62 to convey the sheet S from the fixing device 18 toward the ejection roller pair 63 are disposed.

Image data for printing (image formation) is read by the scanner 300 or received from an external device such as a computer such as a personal computer. For printing, the exposure device 16 writes electrostatic latent images on the respective photoconductors 1 of the image forming devices 20. The developing devices 5 develop the electrostatic latent images to form toner images on the respective photoconductors 1 of the image forming devices 20. The primary transfer devices 13 (Y, M, C, and K) sequentially transfer the toner images formed by the image forming devices 20 onto the intermediate transfer belt 11, thus forming a multicolor toner image.

In parallel to the image forming operation described above, the feeding roller 32 of the first feeding tray 30 or the second feeding tray 31 is selectively rotated to transport the sheet S from the corresponding feeding tray to the sheet conveyance path 60.

Further, timed to coincide with the color toner image to be transported to a secondary transfer position, the pre-registration conveyance roller pair 61 and the registration roller pair 17 are driven to transport the sheet S to the secondary transfer position in the secondary transfer device 15.

The secondary transfer device 15 transfers the multicolor toner image from the intermediate transfer belt 11 onto the sheet S. Then, the fixing device 18 fixes the toner image on the sheet S. Then, the sheet S is conveyed by the post-fixing conveyance roller pair 62, ejected by the ejection roller pair 63, and stacked on the output stack section 70.

In the image forming device 20, the photoconductor cleaning device 2 scrapes off residual toner remaining on the photoconductor 1 after the primary transfer.

In the intermediate transfer device 10, a belt cleaner 14 removes the residual toner on the intermediate transfer belt 11 after the secondary transfer.

Then, the apparatus is prepared for subsequent image formation.

The developing device 5 according to the present embodiment is a two-component developing device that develops (visualizes) electrostatic latent images on a latent image bearer using two component developer including toner and carrier. Two-component developing devices typically include, as developer conveyors to convey the developer, a supply screw to supply the developer onto a developer bearer and a stirring screw to agitate and charge supplied toner (collectively referred to as "conveying screws"). There are developing devices in which one of the supply screw and the stirring screw is disposed above or higher than the other (hereinafter "vertical biaxial developing devices").

Before describing the developing device 5 according to the present embodiment, typical two-component developing devices are described detail below.

If developer scatters out a developing device casing (hereinafter simply "casing"), image failure may occur or the developer may scatter around the image forming apparatus. To prevent such inconveniences for users, preferably the developer is prevented from scattering out the developing device. The developer may leak from around bearing portions of the conveying screws. To address this problem, for example, a seal is provided to prevent the developer from entering the bearing portion or leaking out the developing device.

As another possible cause of inconvenience, heat is generated in the bearing portions, by sliding between the seal and the shaft of the conveying screw. As the bearing is heated, the developer is heated to aggregate. The aggregation can cause image failure. In a worse situation, the toner melts and solidifies on (firmly adheres to) the conveying screw around the bearing, and the developing device locks and results in malfunction of the apparatus.

Therefore, in the bearing portions of the developing device, it is preferred to attain both of "sealing" to prevent scattering of developer out the developing device and "inhibition of temperature rise" caused by the sliding between the seal and the conveying screw. As the sealing performance is enhanced by, for example, increasing the biting amount of the seal, sliding friction between the seal and the rotation shaft (in particular, outer face thereof) of the conveying screw increases. Accordingly, temperature rise increases. On the contrary, if the sealing performance is lowered to suppress the temperature rise, the risk of leak of developer outside the developing device increases.

Thus, balance between "sealing" and "inhibition of temperature rise" is preferred.

In typical developing devices, a driving force from the image forming apparatus is received via an input gear on a rear side of the developing device. Around the input gear to which the driving force is input from the image forming apparatus, there are many heat sources such as a motor and an electronic board of the image forming apparatus. Due to the heat from such heat sources, the bearing is heated more on the rear side of the developing device than the opposite side (front side).

Additionally, in vertical biaxial developing devices, to attain reliable image quality, the developer is collected to the side of the supply screw to prevent shortage of developer supplied to the image bearer. Accordingly, the speed of conveyance of developer by the stirring screw is made faster than that of the supply screw to collect the developer inside the developing device to the front side. A communicating portion through which the developer falls from the supply screw to the stirring screw in the direction of gravity is located on the rear side of the developing device and upstream from the seal in the direction of conveyance by the supply screw. Due to these causes, at the rear end of the developing device, the amount of developer is small and there is a margin to lower the sealing performance on the rear side compared with the front side.

By contrast, in typical horizontal biaxial-circulation developing devices, the amount of developer is similar between the front side and the rear side. Accordingly, to maintain sealing performance in all of the bearing portions (on the front and rear sides of the supply screw and on the front and rear sides of the stirring screw) while suppressing heating of the bearing portions, the shaft of the conveying screw may be made of metal having a high thermal conductivity to disperse the heat from the bearing portions throughout the unit.

There is another inconvenience in the developing device in which the driving force from the image forming apparatus is received on the rear side. When the seals of the bearing portions on the front side and the rear side are identical, the bearing portion on the rear side is heated more than the bearing portion on the front side.

Therefore, in the bearing portions of the developing device, it is preferred to attain both of "sealing" to prevent scattering of developer out the developing device and "inhibition of temperature rise" caused by the sliding between the seal and the conveying screw.

Next, descriptions are given in detail below of the image forming device 20 of the image forming apparatus 500 according to the present embodiment. The image forming devices 20 have a similar configuration except the color of toner used therein, and hereinafter the suffixes Y, M, C, and K are omitted when color discrimination is not necessary.

FIG. 2 is a schematic view of the image forming device 20.

The developing device 5 includes a developing roller 101, serving as a developer bearer and disposed opposite the drum-shaped photoconductor 1, and a rod-shaped developer regulator 104 (developer doctor) disposed opposite the developing roller 101. The developer regulator 104 regulates the layer thickness of developer on the developing roller 101. A casing 5A (in FIG. 3) of the developing device 5 includes a supply compartment 107 (an upper compartment) and a stirring compartment 108 (a lower compartment) to contain the developer. A supply screw 105 having a shaft 105A and a stirring screw 106 having a shaft 106A are disposed in the supply compartment 107 and the stirring compartment 108, respectively. The developing device 5 further includes a concentration sensor 109 to detect the concentration of toner in the developer.

The developing roller 101 includes a stationary magnet 102 (i.e., a magnet roller) and a developing sleeve 103 that rotates around the magnet 102. The supply compartment 107 and the stirring compartment 108 contain two-component developer G including carrier (carrier particles) and toner (toner particles).

The developing device 5 operates as follows. The developing sleeve 103 of the developing roller 101 rotates in the direction indicated by arrow c illustrated in FIG. 2. The developer G is carried on the developing roller 101 due to the magnetic field generated by the magnet 102. As the developing sleeve 103 rotates, the developer G moves along the circumference of the developing roller 101 (in the direction of arc).

The percentage (concentration) of toner in the developer G (ratio of toner to carrier) in the developing device 5 is adjusted to a predetermined range, according to the detection result of the concentration sensor 109 disposed at the bottom of the stirring compartment 108 containing the stirring screw 106. Specifically, according to the consumption of toner in the developing device 5, the toner is supplied via a toner supply passage from the toner bottle 19 to the stirring compartment 108 (the lower of the two developer conveyance compartments) containing the stirring screw 106.

The toner supplied to the stirring compartment 108 is mixed with the developer G therein, and the developer G is circulated between the two developer containing compartments (the supply compartment 107 and the stirring compartment 108) while agitated by the two conveying screws (the stirring screw 106 and the supply screw 105). The toner in developer G is charged by friction with carrier and electrostatically attracted to the carrier. Then, the toner is carried on the developing roller 101 together with the carrier by a magnetic force generated on the developing roller 101.

The developer G carried on the developing roller 101 is transported in the direction indicated by arrow c in FIG. 2 to the rod-shaped developer regulator 104. The amount of developer G on the developing roller 101 is adjusted by the developer regulator 104, after which the developer G is carried to the developing range opposing to the photoconductor 1. Then, the toner in the developer is attracted to the latent image formed on the photoconductor 1 due to the effect of the electrical field generated in the developing range. As the developing sleeve 103 rotates, the developer G remaining on the developing roller 101 reaches an upper part of the supply compartment 107 and drops from the developing roller 101.

The developing device 5 (a vertical biaxial developing device) according to the present embodiment includes the developing roller 101, the supply screw 105 to supply the developer to the developing roller 101, and the stirring screw 106 to agitate and charge the supplied toner. The supply screw 105 and the stirring screw 106 are disposed one above the other, that is, in a vertical arrangement. Further, the developing device 5 employs vertical biaxial-circulation. That is, while the supply screw 105 performs supply of developer to and collection of developer from the developing roller 101, the developer is circulated between the supply screw 105 and the stirring screw 106.

The developing device 5 employing vertical biaxial-circulation is described in further detail below with reference to the drawings.

Figure 3:
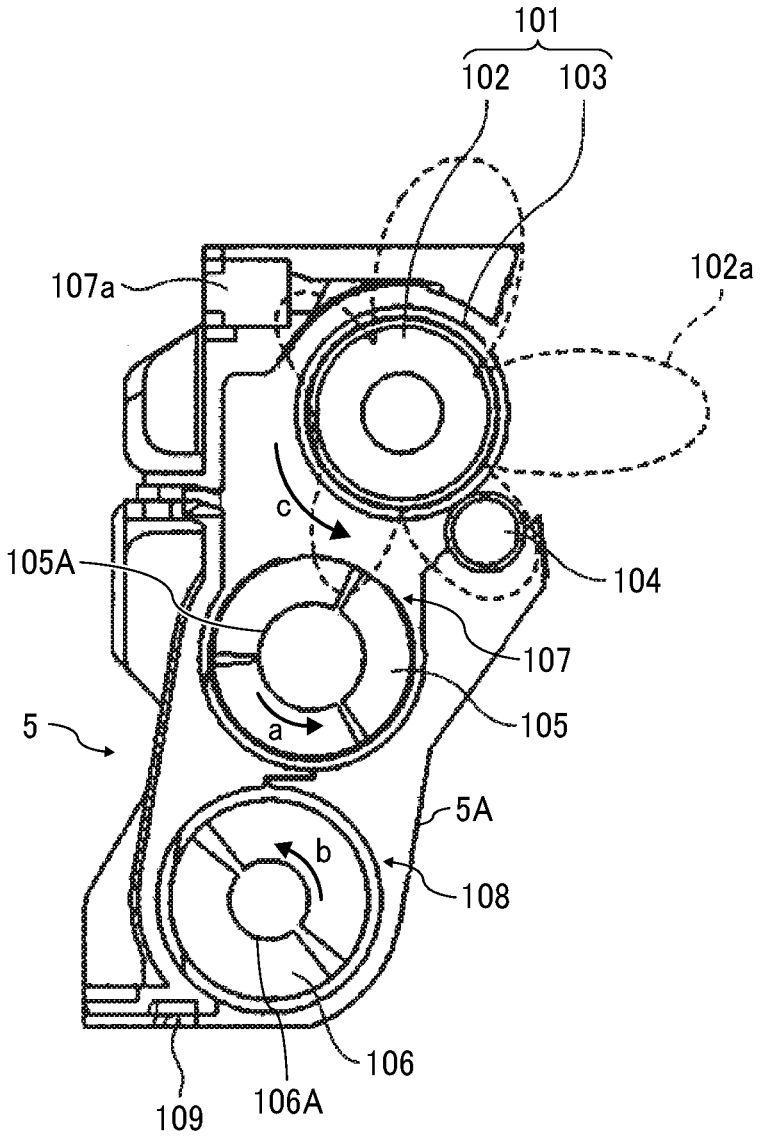
FIG. 3 is an end-on axial view of a vertical biaxial-circulation developing device according to an embodiment.

FIG. 3 is an end-on axial view of the vertical biaxial-circulation developing device 5.

As illustrated in FIG. 3, the developing device 5 includes the developing roller 101 (developer bearer) constructed of the magnet 102 and the developing sleeve 103 having five magnetic poles. In FIG. 3, a line 102*a* (broken lines) represents the magnetic flux density in the direction normal to the surface of the developing roller 101. The developer regulator 104 is a rod made of Steel Special Use Stainless (SUS) according to Japan Industrial Standard (JIS). The developer regulator 104 is at a distance (a gap called doctor gap) from the developing roller 101 and secured to the casing 5A of the developing device 5.

The casing 5A (serving as a developer container) of the developing device 5 is partitioned into the stirring compartment 108 containing the stirring screw 106 to stir and charge the supplied toner and the supply compartment 107 containing the supply screw 105 to supply the developer to the developing roller 101. The supply compartment 107 and the stirring compartment 108 are in a vertical arrangement. The supply screw 105 and the stirring screw 106 rotate in the directions respectively indicated by arrow a and arrow b illustrated in FIG. 3 to transport the developer, thereby circulating the developer between the supply compartment 107 and the stirring compartment 108.

The developer transported to the supply compartment 107 is scooped onto the developing roller 101 by the magnetic force exerted by the developing roller 101. The developer is transported by the developing sleeve 103 rotating in the direction indicated by arrow c in FIG. 3. After the developer regulator 104 adjusts the amount of the developer thereon, the developer is transported to the developing range opposite the photoconductor 1. After the toner therein is consumed in the developing range, the developer on the developing roller 101 is returned into the developing device 5, separated from the developing sleeve 103 by a release pole (magnetic pole of the magnet 102), and mixed with toner in the supply compartment 107. As the developer is returned into the developing device 5, airflow is generated. The developing device 5 includes a vent covered with a pressure-release filter 107*a* to suppress an internal pressure rise caused when the developer is returned into the casing 5A.

Next, descriptions are given below of flow (circulation) of developer in the longitudinal direction of the developing device 5 employing vertical biaxial-circulation.

Figure 4:
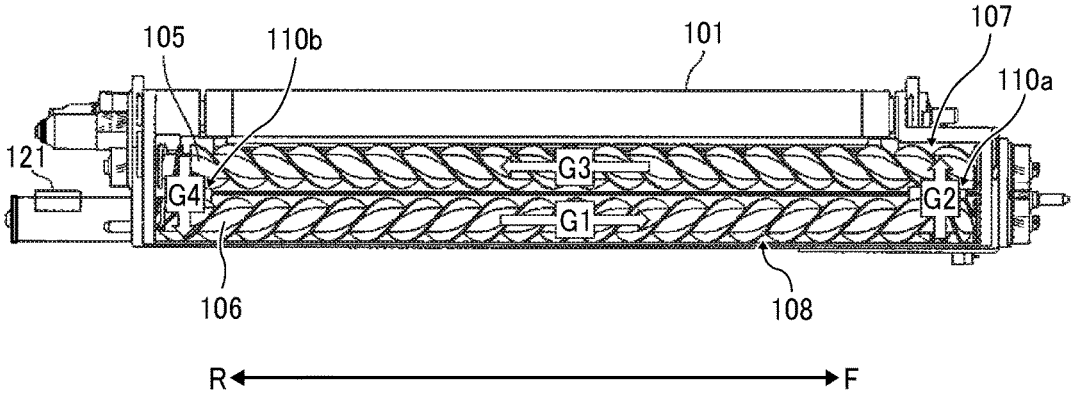
FIG. 4 illustrates flow of developer in the longitudinal direction in the vertical biaxial-circulation developing device illustrated in FIG. 3.

FIG. 4 illustrates the flow of developer in the longitudinal direction in the vertical biaxial-circulation developing device 5.

As described above with reference to FIG. 2, in the vertical biaxial-circulation developing device 5 according to the present embodiment, the supply screw 105 and the stirring screw 106 are disposed one above the other (in vertical arrangement).

In the developing device 5, the stirring screw 106 rotates to transport the developer in the direction indicated by arrow G1 in FIG. 4 to the downstream side in the direction of developer conveyance thereof, which is on a front side F of the image forming apparatus 500 when the developing device 5 is mounted therein). The downstream end (on the front side F) in the direction of developer conveyance by the stirring screw 106 is defined by a front end wall (i.e., an inner wall face) of the casing 5A and the developer accumulating there is pushed by the developer transported from behind. The pushed developer is lifted through a first communicating portion 110*a* on the front side F. As the stirring compartment 108 communicates with the supply compartment 107 in the first communicating portion 110*a*, the developer is lifted as indicated by arrow G2, to the supply screw 105.

As the supply screw 105 rotates, the developer is transported in the direction indicated by arrow G3 to a rear side R, and a portion of the developer is supplied to the developing roller 101. After contributed to image developing, the developer is returned therefrom to the supply screw 105. On the downstream side of the supply screw 105 in the developer conveyance direction (the rear side R), the supply compartment 107 communicates with the stirring compartment 108 through a second communicating portion 110*b* located closer to the center in the longitudinal direction than the rear end wall of the casing 5A. The developer transported to the downstream side (the rear side R) does not impact on the rear end wall but falls under the gravity in the direction indicated by arrow G4 onto the stirring screw 106.

While the developer inside the developing device 5 is deprived of toner in developing the electrostatic latent image on the photoconductor 1, toner is supplied from the toner supply inlet 121 to the stirring compartment 108, and the developer is circulated between the stirring compartment 108 and the supply compartment 107.

If the amount of developer is insufficient in the supply compartment 107 containing the supply screw 105, the developer is not supplied to the developing roller 101 (shortage of developer). Therefore, it is preferred to collect the developer in the developing device 5 to the supply screw 105. In particular, in the developing device 5 employing vertical biaxial-circulation, since the developer is pushed up from the stirring screw 106 to the supply screw 105, against the gravity, through the first communicating portion 110*a* on the front side F, the conveyance efficiency is lowest. Accordingly, in the developing device 5, the developer conveyance speed of the stirring screw 106 is made faster than that of the supply screw 105 to collect the developer to the downstream end of the stirring screw 106, thereby actively sending the developer to the supply screw 105.

The balance of developer in the developing device 5 is described below referring to the drawings.

Figure 5:
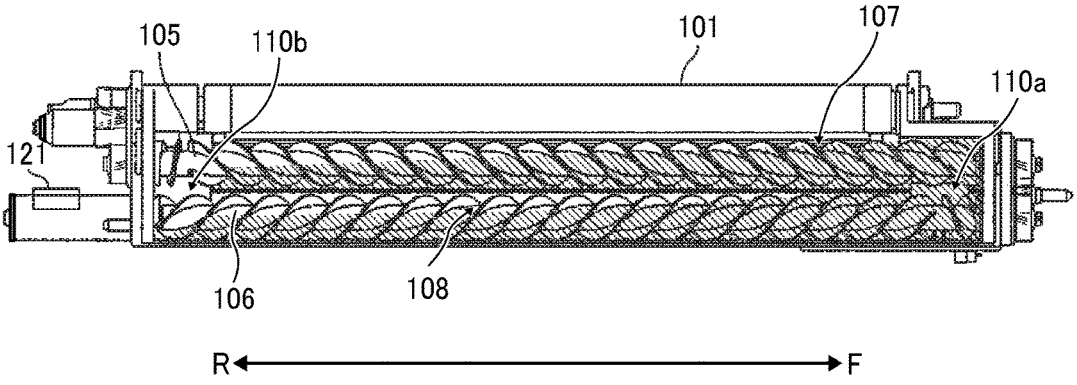
FIG. 5 illustrates balance of developer in the vertical biaxial-circulation developing device illustrated in FIG. 3.

FIG. 5 is a cross-sectional view, from a side, of the vertical biaxial-circulation developing device 5 and illustrates the balance of developer therein.

As described above with reference to FIG. 4, in vertical biaxial-circulation, since the developer conveyance efficiency decreases in the first communicating portion 110*a* on the front side F, where the developer is pushed up, the developing device 5 is configured to collect the developer to the downstream end of the stirring screw 106. Accordingly, as illustrated in FIG. 5, in the stirring compartment 108 (i.e., developer conveyance route of the stirring screw 106), the developer accumulates in the first communicating portion 110*a*, and the amount of developer is smaller on the upstream side of the stirring screw 106.

In the supply compartment 107 (i.e., developer conveyance route of the supply screw 105), on the upstream side of the supply screw 105, the amount of developer is largest and the level of the developer is highest. The level of the developer decreases toward the downstream side of the supply screw 105. Further, on the downstream side of the supply screw 105, the second communicating portion 110*b* is located in front of (upstream in the developer conveyance direction from) the rear end wall (inner wall face) adjacent to the bearing provided with a seal (e.g., 112*a* in FIG. 7A or 112*b* in FIG. 7B). Through the second communicating portion 110*b*, the developer falls under the gravity from the supply screw 105 to the stirring screw 106. Accordingly, there is almost no developer near the seal on the downstream side.

Therefore, on the rear side R of the developing device 5 (downstream side of the supply screw 105 and the upstream side of the stirring screw 106), there can be a margin to lower the sealing performance of the seal in the bearing portion, compared with the front side F (upstream side of the supply screw 105 and the downstream side of the stirring screw 106).

Next, descriptions are given below of the flow of developer in a comparative developing device employing horizontal biaxial-circulation with reference to FIGS. 6A and 6B.

Figure 6A:
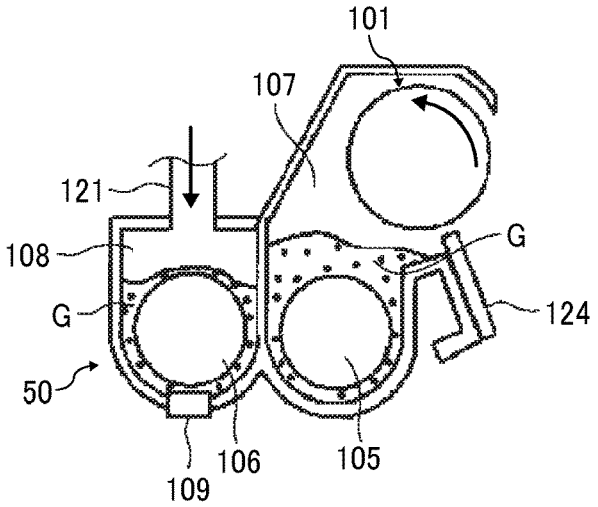
FIGS. 6A and 6B illustrate flow of developer in a horizontal biaxial-circulation developing device according to a comparative example.

FIG. 6A is an end-on axial view of a developing device 50 employing horizontal biaxial-circulation. FIG. 6B is a perspective view of the horizontal biaxial-circulation developing device 50 and illustrates the flow of developer therein.

As illustrated in FIG. 6A, the developing device 50 includes a developing roller 101, serving as a developer bearer and disposed opposite the photoconductor 1, and a doctor blade 124 serving as a developer regulator. An end of the doctor blade 124 is opposed to the developing roller 101. The casing of the developing device 50 is partitioned into a stirring compartment 108, in which a stirring screw 106 (a conveying screw) is disposed, and a supply compartment 107, in which a supply screw 105 (a conveying screw) is disposed. The stirring screw 106 agitates and charges supplied toner, and the supply screw 105 supplies the developer to the surface of the developing roller 101. The supply compartment 107 is on a lateral side of the stirring compartment 108.

A toner supply inlet 121 through which toner is supplied is disposed on the upper side of one end of the stirring compartment 108. A concentration sensor 109 to detect the toner concentration is disposed on the bottom or below the stirring compartment 108.

Similar to that of the developing device 5 described above with reference to FIG. 2, the developing roller 101 includes a stationary magnet and a sleeve that rotates around the magnet. The supply compartment 107 and the stirring compartment 108 contains developer G including carrier and toner.

Operation of the developing device 50 is described below. The sleeve of the developing roller 101 rotates in the direction indicated by an arrow illustrated in FIG. 6A. The developer held on the developing roller 101 by the magnetic field generated by the magnet moves along the circumference of the developing roller 101 (in the direction of arc) as the sleeve rotates.

The percentage (concentration) of toner in the developer G (ratio of toner to carrier) in the developing device 50 is adjusted to a predetermined range. More specifically, in accordance with the consumption of toner in the developing device 50, the toner is conveyed from the toner bottle 19 through a toner supply passage and supplied to the stirring compartment 108 from the toner supply inlet 121.

The toner supplied to the stirring compartment 108 is mixed with the developer G therein, and the developer G is circulated between the supply compartment 107 and the stirring compartment 108 while agitated by the stirring screw 106 and the supply screw 105. The toner in developer G is charged by friction with carrier and electrostatically attracted to the carrier. Then, the toner is carried on the developing roller 101 together with the carrier by a magnetic force generated on the developing roller 101.

The developer carried on the developing roller 101 is transported in the direction indicated by the arrow illustrated in FIG. 6A to the doctor blade 124. The amount of developer G on the developing roller 101 is adjusted at that position, after which the developer G is carried to the developing range opposing to the photoconductor 1. Then, the toner in the developer is attracted to the latent image formed on the photoconductor 1 due to the effect of the electrical field generated in the developing range. As the developing sleeve 103 rotates, the developer G remaining on the developing roller 101 reaches an upper part of the supply compartment 107 and drops from the developing roller 101.

Figure 6B:
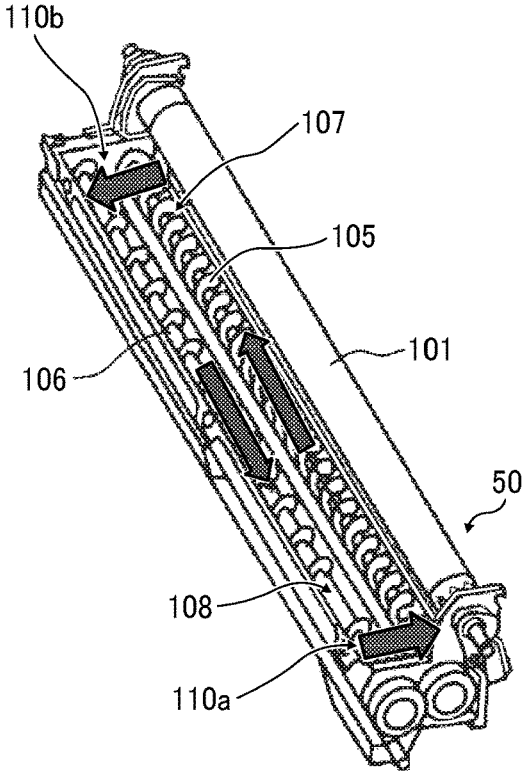

Regarding the longitudinal direction in the horizontal biaxial-circulation developing device 50, the developer in the stirring compartment 108 flows as indicated by an arrow in FIG. 6B as the stirring screw 106 rotates. Since the downstream end in the direction of developer conveyance by the stirring screw 106 is defined by a front end wall (i.e., an inner wall face), the developer accumulating there is pushed by the developer transported from behind through a first communicating portion 110*a* to the supply screw 105. In the supply compartment 107, as the supply screw 105 rotates, while the developer is transported in the direction indicated by an arrow, a portion of the developer is supplied to the developing roller 101. After contributed to image formation, the developer is returned to the supply screw 105.

At the downstream end of the supply screw 105, while the developer is blocked by wall, the developer is pushed by the developer from behind to pass through the second communicating portion 110*b* toward the stirring screw 106.

Thus, in horizontal biaxial-circulation developing device 50, at the downstream end of the conveying screw near the end wall, being pushed by the developer coming from behind, the developer passes through the communicating portion to the other conveying screw while pressing against the inner wall face of the casing. Accordingly, differently from the developing device 5 employing vertical biaxial-circulation, it is not preferred to lower the sealing performance in the bearing portion on one side.

Figure 7A:
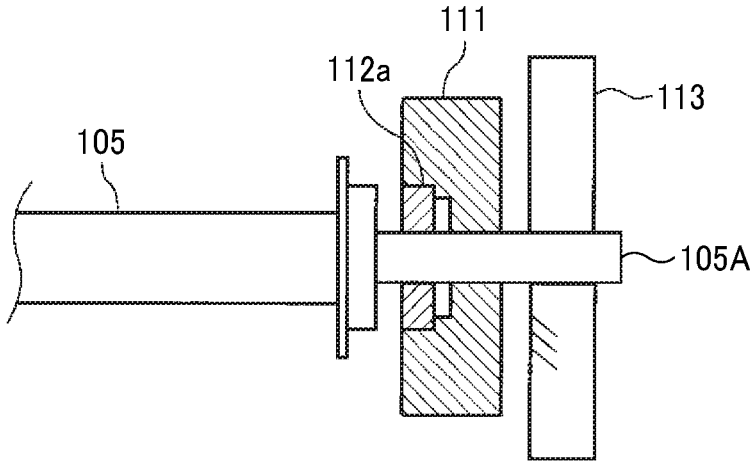
FIG. 7A is a cross-sectional view, from a side, of a bearing portion of a conveying screw of according to an embodiment.
Figure 7B:
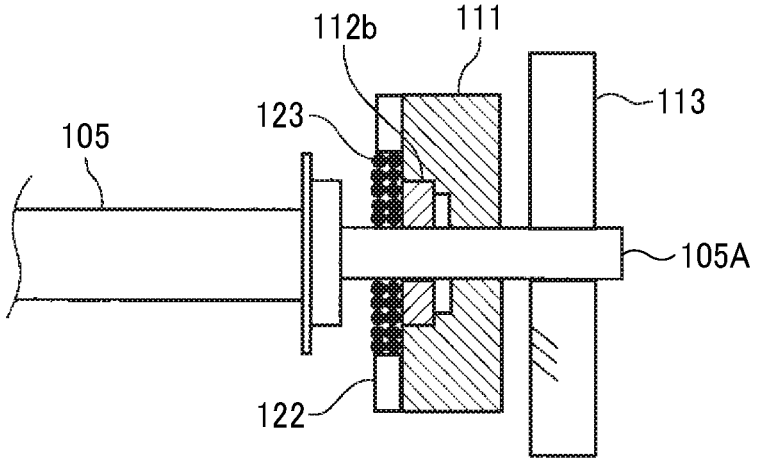
FIG. 7B is a cross-sectional view, from a side, of a bearing portion of a conveying screw according to an embodiment.

Descriptions are given of the bearing portions of the conveying screws with reference to FIGS. 7A and 7B.

FIG. 7A is a cross-sectional view, from a side, of the bearing portion provided with a seal made of resin, rubber, or the like. FIG. 7B is a cross-sectional view, from a side, of the bearing portion provided with a seal having a lower sliding friction, such as fabric seal.

Referring to FIG. 7A, descriptions are given below of a typical seal made of resin, rubber, or the like.

As illustrated in FIG. 7A, the shaft 105A of the supply screw 105 is received in a bearing 111 provided with a seal 112*a*, which is a typical seal made of resin, rubber, or the like, to prevent developer from entering the bearing 111. Further, a driving gear 113 to drive the supply screw 105 is attached to the shaft 105A of the supply screw 105. The driving gear 113 is disposed outward of the bearing 111 in the longitudinal direction of the supply screw 105 (closer to the end of the shaft 105A than the bearing 111).

As described above, regarding the seal 112*a*, it is preferred to balance the sealing performance with the inhibition of temperature rise caused by the sliding between the seal 112*a* and the conveying screw (the supply screw 105 in FIG. 7A). The seal 112*a* is made of, for example, resin or rubber, to enhance the sealing performance. To balance sealing performance with inhibition of temperature rise, the thickness or the width of the seal is adjusted to change the amount of biting in the shaft of the conveying screw.

By contrast, focusing on "inhibition of temperature rise", a brush seal 112*b* illustrated in FIG. 7B, made of, for example, cloth or fabric (e.g., pile fabric) may be used to reduce the sliding friction between the shaft (the outer face thereof) of the conveying screw and the seal (the face in contact with the shaft). However, compared with the seal made of resin or the like, the brush seal 112*b* has a lower sealing capability, and the risk of leak of developer increases.

In view of the foregoing, as illustrated in FIG. 7B, when the brush seal 112*b* is used, a magnetic seal 122 is attached to the brush seal 112*b*. The magnetic seal 122 is disposed on the front side of the brush seal 112*b* (on a side of the brush seal 112*b* facing a center side in the longitudinal direction of the supply screw 105). With this structure, in the example illustrated in FIG. 7B, the carrier included in the developer forms a curtain 123 between the supply screw 105 (the conveying screw) and the magnetic seal 122 to inhibit the developer from entering the seal 112*b*.

Descriptions are given below of a plurality of examples of the vertical circulation developing device 5 and a variation (a developing device 25).

(Embodiment 1)

In Embodiment 1, the developing device 5 employs vertical biaxial-circulation, and the seal (having a sliding friction lower than that on the front side F is used only in the bearing portion on the rear side R of the stirring screw 106 (located on the rear side of the image forming apparatus 500 when the developing device 5 is mounted therein). That is, the seal lower in sliding friction is disposed on the upstream side of the stirring screw 106 in the developer conveyance direction of the stirring screw 106.

Figure 8A:
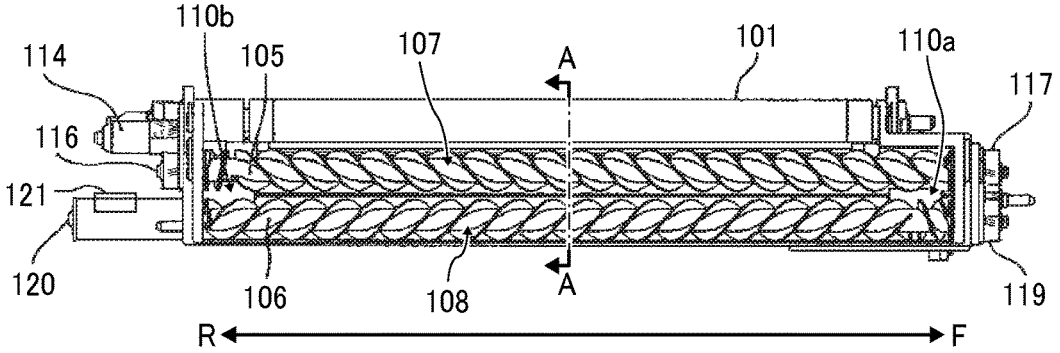
FIG. 8A is a view in a longitudinal direction of a developing device according to Embodiment 1.
Figure 8B:
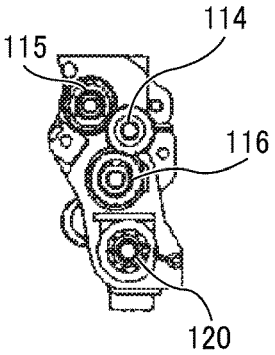
FIG. 8B is an external view of a rear side of the developing device according to Embodiment 1.
Figure 8C:
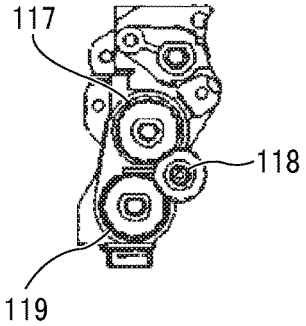
FIG. 8C is an external view of a front side of the developing device according to Embodiment 1.
Figure 8D:
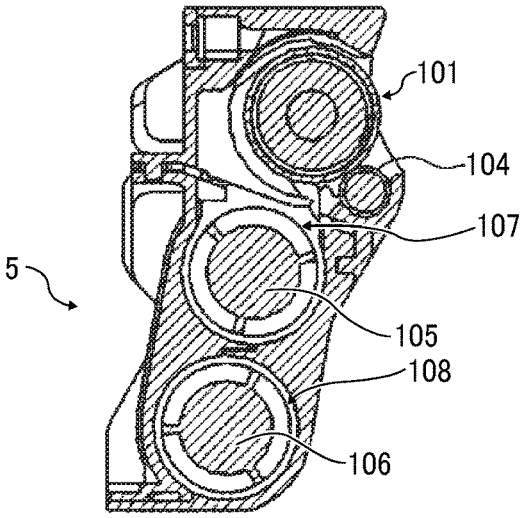
FIG. 8D is a cross-sectional view of the developing device along line A-A in FIG. 8A.

FIG. 8A is a view of the developing device 5 in the longitudinal direction. FIG. 8B is an external view of the rear side R of the developing device 5, and FIG. 8C is an external view of the front side F of the developing device 5. FIG. 8D is a cross-sectional view of the developing device 5 along line A-A in FIG. 8A.

As illustrated in FIGS. 8A and 8B, on the rear side R of the developing device 5, an input gear 114 (an idler gear) is disposed to input a driving force from the body 200 to the developing device 5. The input gear 114 is coupled to a developing gear 115 to drive the developing roller 101 and a supply gear 116 to drive the supply screw 105. As illustrated in FIGS. 8A and 8C, a front side gear 117 is attached to the end portion of the supply screw 105 on the front side F, and rotation of the supply screw 105 is transmitted from the front side gear 117 via a transmission gear 118 (an idler gear) to a stirring gear 119 to drive the stirring screw 106.

The seal 112*a* illustrated in FIG. 7A is disposed in each of the bearing portions of the supply screw 105 on the rear side R (adjacent to the supply gear 116) and the front side F (adjacent to the front side gear 117) and the bearing portion of the stirring screw 106 on the front side F (adjacent to the stirring gear 119). In the present embodiment, the seals 112*a* are resin seals and common to these three bearing portions.

As illustrated in FIGS. 8A and 8B, since a rear end portion 120 of the casing 5A to support the rear-side end portion of the stirring screw 106 is shaped like a sac, the developer does not leak from the rear end portion 120 outside the developing device 5. Accordingly, the seal 112*a* used in the rear end portion 120 is a resin seal that is lower in sealing performance and lower in sliding friction than those of the seals 112*a* used in the above-mentioned three bearing portions. To lower the sealing performance of the resin seal, as described above, for example, the thickness or the width of the seal is adjusted to change the amount of biting in the shaft 106A of the stirring screw 106.

The toner is supplied from the toner supply inlet 121 disposed near the rear end of the stirring screw 106 similar to the structure illustrated in FIG. 4, and the flow of developer is similar to the description above with reference to FIG. 4. The balance of developer in the developing device 5 according to the present embodiment is similar to the description above with reference to FIG. 5.

The developing roller 101 illustrated in FIG. 81) includes a developing sleeve 103 and a magnet 102. A rod-shaped developer regulator 104 opposes the developing roller 101 from below across a gap (the doctor gap) from the developing roller 101. The developer regulator 104 regulates the amount of developer passing through the doctor gap. In the present embodiment, the developer regulator 104 is made of magnetic metal.

In FIGS. 8A and 8D, the supply screw 105 and the stirring screw 106 are arranged one above the other. The supply screw 105 is 15 mm in outer diameter and 8 mm in shaft diameter. The supply screw 105 is triple-threaded and made of resin. The stirring screw 106 is 15 mm in outer diameter and 6 mm in shaft diameter. The stirring screw 106 is double-threaded and made of resin similar to the supply screw 105.

The above-described outer diameters, the shaft diameters, and the number of threads of the supply screw 105 and the stirring screw 106 are set to inhibit the shortage of developer in the supply compartment 107 containing the supply screw 105 described above with reference to FIG. 4. Such setting makes the developer conveyance speed of the stirring screw 106 faster than that of the supply screw 105 to collect the developer to the first communicating portion 110*a* (on the front side F of the developing device 5) through which the developer is pushed up. Accordingly, a greater amount of developer can be sent toward the supply screw 105. Thus, the developer is collected to the supply screw 105 to inhibit the shortage of developer on the side of the supply screw 105.

Next, descriptions are given below of a measurement result of temperature rise in the bearing portion of the conveying screw of the developing device 5 according to the present embodiment.

Figure 9:
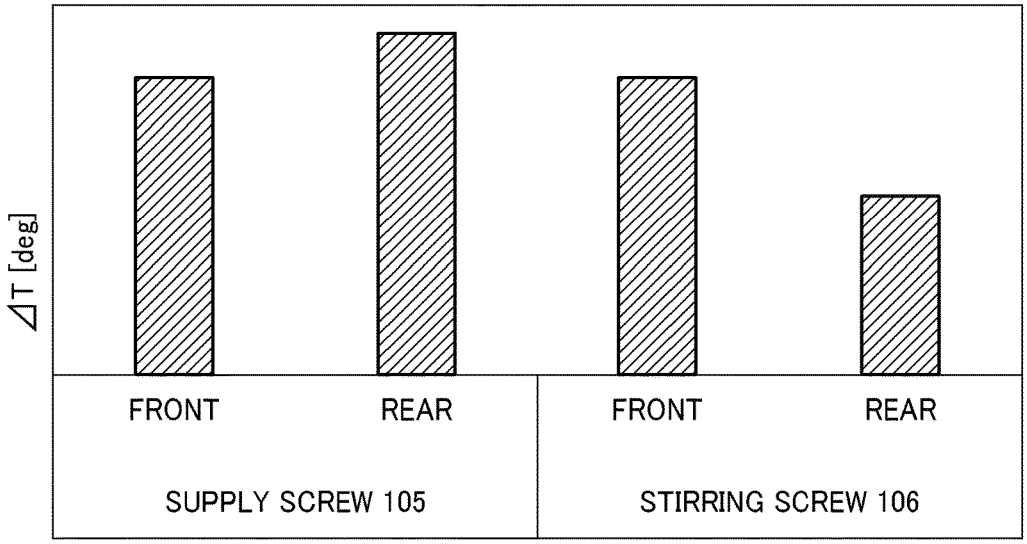
FIG. 9 is a graph of a measurement result of temperature rise in the bearing portions according to Embodiment 1.

FIG. 9 is a graph of the measurement result of temperature rise in the bearing portions according to the present embodiment, and a vertical axis represents a temperature rise ΔT of the bearing portions from an ambient temperature.

As can be known from FIG. 9, although the seals 112*a* used on the bearings portions on the front side F and the rear side R of the supply screw 105 and the seal 112*a* used in the bearing portion on the front side F of the stirring screw 106 were identical, the temperature rise ΔT on the rear side R of the supply screw 105 was greater by about 2 to 3 degrees than that on the front side F of the supply screw 105. This is because heat generation of the input gear 114 affects the bearing portion on the rear side R of the supply screw 105.

By contrast, the temperature rise ΔT was smallest in the bearing portion on the rear side R of the stirring screw 106 using the seal lower in sliding friction than the seal 112*a* on the front side F of the stirring screw 106.

(Embodiment 2)

In Embodiment 2, the developing device 5 employs vertical biaxial-circulation, and the seal having a sliding friction lower than that on the front side F is used in the bearing portion on the rear side R of each of the supply screw 105 and the stirring screw 106 (on the rear side R when the developing device 5 is mounted in the body 200).

Figure 10A:
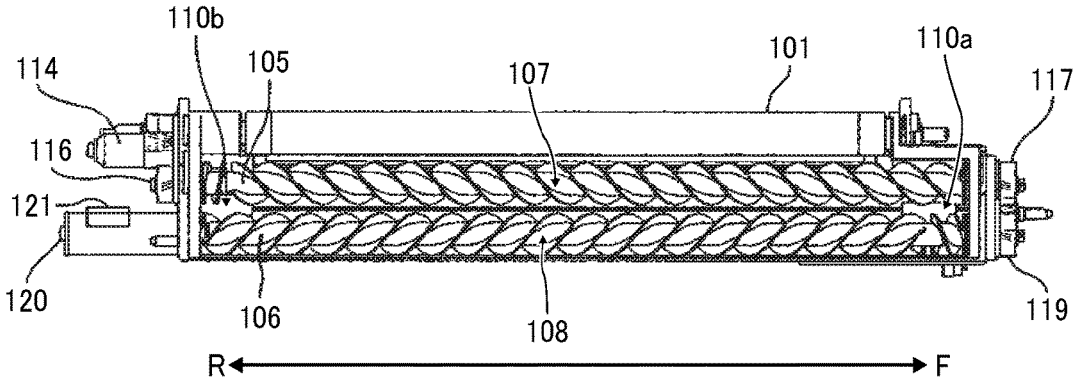
FIGS. 10A to 10C are views of a developing device according to Embodiment 2.
Figure 10B:
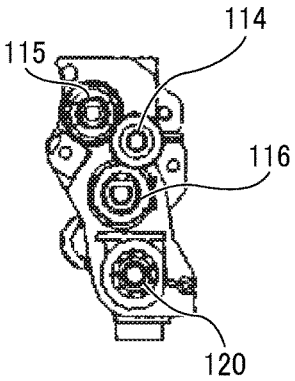

FIG. 10A is a view of the developing device 5 in the longitudinal direction. FIG. 10B is an external view of the rear side R of the developing device 5, and FIG. 10C is an external view of the front side F of the developing device 5.

Figure 10C:
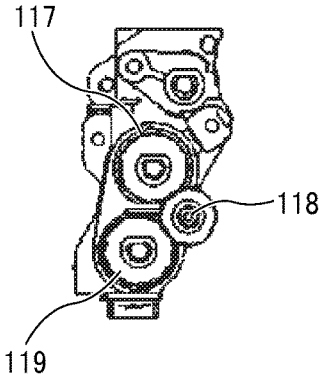

The developing device 5 illustrated in FIGS. 10A to 10C is similar to that according to Embodiment 1 except the following differences.

In Embodiment 2, the seals 112*a* that are resin seals are used on the front side F of each of the supply screw 105 and the stirring screw 106, and the brush seal 112*b* illustrated in FIG. 7B, made of pile fabric, is used on the rear side 1*t* of the supply screw 105.

This structure reduces the temperature rise (heating amount) of the bearing portion on the rear side R of the supply screw 105 compared with the bearing portion on the front side F.

Similar to the bearing structure illustrated in FIG. 7B, the magnetic seal 122 is disposed on the front side of the brush seal 112*b* (on the side of the brush seal 112*b* facing the center side in the longitudinal direction of the developing device 5).

Form the following reason, the brush seal 112*b* lower in sealing performance than a resin seal is usable in the end portion of the supply screw 105 on the rear side R of the developing device 5.

The developing device 5 according to Embodiment 2 employs vertical biaxial-circulation, and the second communicating portion. Hob on the rear side R is disposed in front (upstream) of the seal 112*b* on the downstream side of the supply screw 105 to use the gravity to circulate the developer.

Accordingly, almost no pressure is applied to the inner wall at the downstream end of the supply screw 105 when the developer is sent from the supply screw 105 (the upper developer conveyor) to the stirring screw 106 (the lower developer conveyor). As a result, compared with horizontal biaxial-circulation in which the developer is sent while pressing the developer against the inner wall provided with a seal, the amount of at the periphery of the seal can be very small.

Next, descriptions are given below of a measurement result of temperature rise in the bearing portion of the supply screw 105 of the developing device 5 according to the present embodiment.

Figure 11:
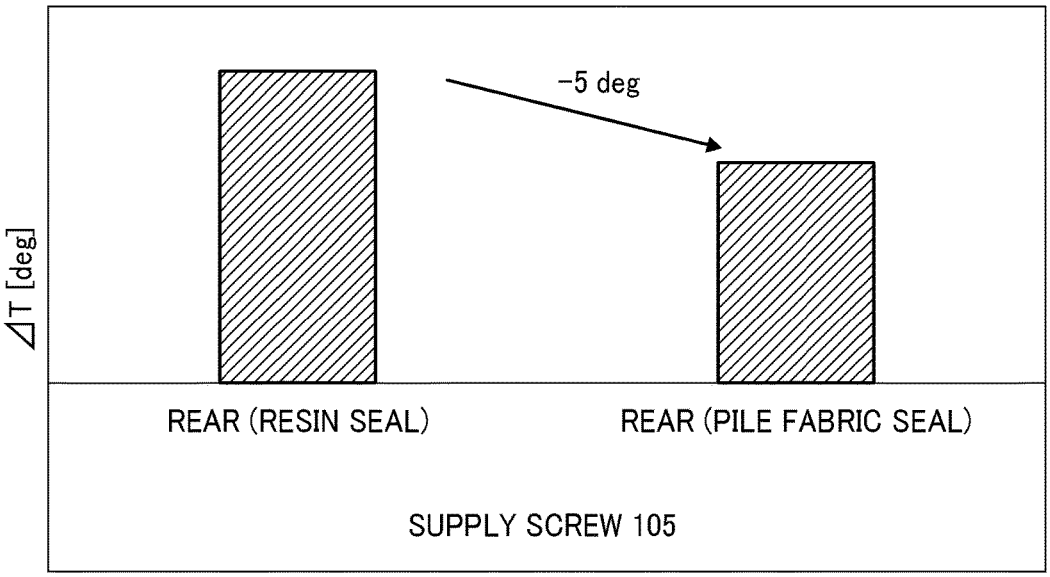
FIG. 11 is a graph of the measurement result of temperature rise on the rear side of a supply screw in a case where a resin seal according Embodiment 1 is used and a case where a brush seal according to Embodiment 2 is used.

FIG. 11 is a graph of the measurement result of temperature rise of the bearing portion on the rear side R of the supply screw 105 when the resin seal 112*a* is used (according Embodiment 1) and the brush seal 112*b* is used (according to Embodiment 2), and a vertical axis represents the temperature rise ΔT of the bearing portion from the ambient temperature.

As illustrated in FIG. 11, compared with the case where the resin seal (Embodiment 1) was used on the rear side R of the supply screw 105, the temperature rise ΔT in the bearing portion was smaller by about 5 degrees in the case where the brush seal 112*b* was used.

Further, when the endurance of the developing device 5 according to the present embodiment was tested, the developer did not leak from the bearing portions of the conveying screws. This result ascertains that temperature rise can be inhibited while maintaining the sealing performance in the vertical biaxial-circulation developing device when the brush seal is used as the seal in the bearing portion on the rear side.

(Modification)

As modifications, the seals according to Embodiments 1 and 2 can be used in a vertical biaxial developing device 25 in which the developer regulator is disposed on the upper side of the developing roller 101 and the developer supplied from the supply screw 105 is collected to the side of the stirring screw 106.

Figure 12A:
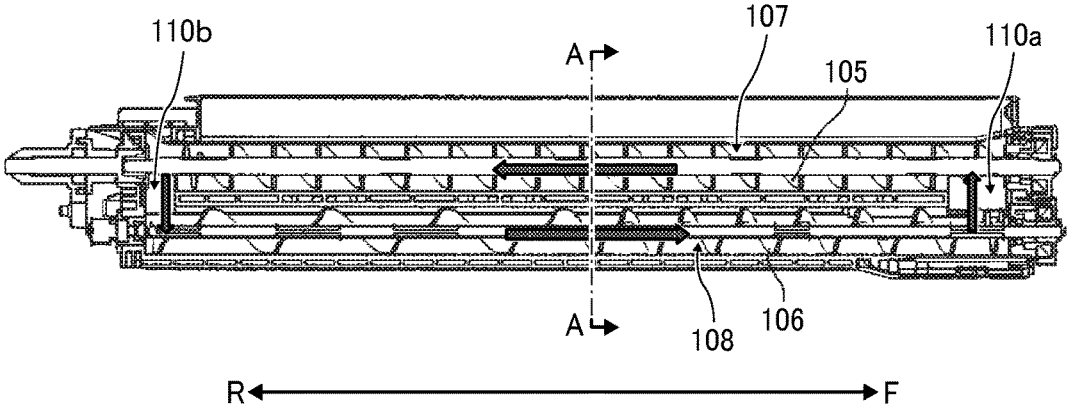
FIG. 12A is a cross-sectional view in a longitudinal direction of a developing device according to a modification.
Figure 12B:
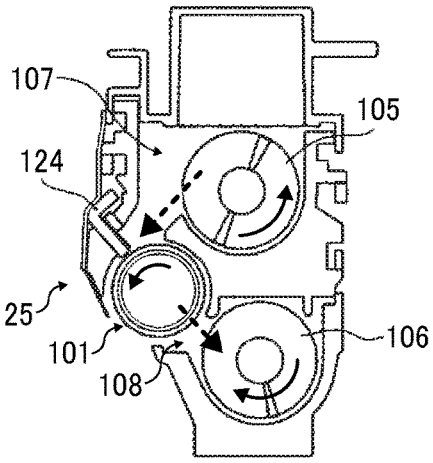
FIG. 12B is an end-on axial view of the developing device along line A-A in FIG. 12A.

FIGS. 12A and 12B illustrate the developing device 25 according to the present modification. FIG. 12A is a cross-sectional view of the developing device 25 in the longitudinal direction, and FIG. 12B is an end-on axial view along line A-A in FIG. 12A.

In the developing device 5 according to Embodiment 1 illustrated in FIGS. 8A to 8D or that according to Embodiment 2 illustrated in FIGS. 10A to 10C, the developer regulator 104 is located on the lower side of the developing roller 101.

However, application of the seals according to Embodiments 1 and 2 is not limited to the above-described developing device 5. Alternatively, for example, the vertical biaxial developing device 25 described below can use the above-described seals according to Embodiments 1 and 2.

In the developing device 25 according to the present modification, as illustrated in FIG. 12B, the doctor blade 124 serving as the developer regulator is disposed on the upper side of the developing roller 101, and the developer supplied from the supply screw 105 is collected to the side of the stirring screw 106 as indicated by broken arrows in FIG. 12B.

Even in the developing device 25 having such a structure, the second communicating portion blob through which the developer flows down under the gravity is located in front of (upstream in the developer conveyance direction from) the downstream end of the supply screw 105 in FIG. 12A. Accordingly, the amount of developer at the downstream end of the supply screw 105 is very small. Accordingly, the sealing performance of the bearing portion on the rear side R of the supply screw 105 can be lowered.

Similar to the vertical biaxial-circulation developing device 5 according to Embodiment 1 or 2, in the vertical biaxial developing device 25, the supply screw 105 and the stirring screw 106 are in a vertical arrangement (disposed one above the other).

In the portion near the second communicating portion 110*b* where the developer is sent down under the gravity from the supply screw 105 (the upper developer conveyor) to the stirring screw 106 (the lower developer conveyor), the seal can be lower in sealing performance, that is, lower in sliding friction, than the seals used in other bearing portions.

That is, in vertical biaxial developing devices like the developing device 25, regardless of the position of the developing roller 101, the position and the shape of the doctor blade 124 and the like relative to the developing roller 101, the flow of developer on the cross section of the developing device 25, the seal of lower sliding friction can be used on the portion where the developer is sent down under the gravity from the upper conveying screw (e.g., the supply screw 105) to the lower conveying screw (e.g., the stirring screw 106.

The structures of the embodiments and the modification described above are just examples, and the various aspects of the present specification attain respective effects as follows.

Aspect A

A developing device (e.g., the developing devices 5 and 25) includes an upper developer conveyor (e.g., the supply screw 105) and a lower developer conveyor (e.g., the stirring screw 106) disposed below the upper developer conveyor. Each of the upper developer conveyor and the lower developer conveyor has a rotation shaft (e.g., the shafts 105A and 106A in FIG. 3) and is configured to convey developer to one side in the axial direction thereof. The developing device further includes a communication portion (e.g., the second communicating portion 110*b*) through which the developer falls from the upper developer conveyor to the lower developer conveyor, and the communication portion is disposed on a first end side, serving as a drive input side, of the developing device on which the input gear 114 to input a rotation driving force to the developing device is disposed.

The developing device further includes first end seals (e.g., he seals 112*a* and 112*b*) to seal the gap between the rotation shaft and the bearings (e.g., the bearings 111) supporting first end portions (on the drive input side) of the rotation shafts of the upper developer conveyor and the lower developer conveyor. The device further includes second end seals (e.g., the seals 112*a*) to seal the gap between the rotation shaft and the bearings (111) supporting second end portions (opposite the drive input side) of the rotation shafts of the upper developer conveyor and the lower developer conveyor. A sliding friction between the rotation shaft and at least one of the first end seals on the first end side (drive input side) is smaller than a sliding friction between the rotation shaft and the second end seal on the second end side.

With this configuration, the following effects are attained.

Typically, an input gear to receive a rotation driving force to drive the developing device from the image forming apparatus is disposed on one end side (first end side or drive input side) of the developing device in the longitudinal direction of the developing device, and the drive input side is generally located on the rear side when the developing device is mounted in the image forming apparatus. Around the input gear to receive the driving force from the image forming apparatus, there are many heat sources such as a motor and an electronic board of the image forming apparatus. Due to the heat from such heat sources, the bearing on the drive input side is heated more than the bearing on the second end side (e.g., front side) in the longitudinal direction.

This phenomenon occurs also in developing devices in which the seal disposed on the bearing on the upstream side of the developer conveyor in the developer conveyance direction is lower in sealing performance than the seal disposed on the bearing on the opposite side.

There arise a risk of temperature rise of the bearing of the developer conveyor whose downstream side in the developer conveyance direction is located on the drive input side and a risk of leak of developer outside the developing device from the bearing on the opposite side, that is, on the upstream side of the developer conveyor in the developer conveyance direction.

By contrast, according to Aspect A, the sliding friction between the rotation shaft (the shaft 105A) and the seal (e.g., the seals 112*a* and 112*b*) is made lower in at least one of the bearings (e.g., the bearing 111) on the first end side (the drive input side on which the input gear 114 is disposed) than in the bearings on the second end side. By reducing the sliding friction, temperature rise of the bearing 111 is inhibited on the first end side (drive input side) compared with a case where the sealing performance on the drive input side is made higher than the second end side (e.g., the front side). Lowering the sliding friction by reducing sealing performance is also advantageous in suppressing the torque of (load on) the developing device.

The second communicating portion 110*b* (i.e., a developer falling opening) through which the developer falls down is typically disposed such that the bearings above and below the developer falling opening are less likely to be sourced with developer. According to this aspect, the developer falling opening is disposed on the first end side (side of the input gear 114). When the developer falling opening is disposed on the first end side (drive input side), the amount of developer that contacts the seals (112*a* or 112*b*) on the bearings 111 on the first end side (drive input side) can be smaller than the amount of developer that contacts the seals on the second end side.

With this features, the sealing performance and inhibition of temperature rise can be balanced in the bearing 111 on the drive input side on which the temperature tends to be higher than the other side.

Additionally, regarding the bearing 111 on the second end side, the sliding friction between the seal 112*a* and the conveying screw can be set to secure the sealing performance to prevent leak of developer outside the developing device 5 from the bearing 111.

With this features, the sealing performance and inhibition of temperature rise can be balanced in the bearing 111 on the second end side on which the temperature tends to be lower than the drive input side.

Accordingly, the sealing performance and inhibition of temperature rise can be secured in the bearings 111 of the developer conveyors (the supply screw 105 and the stirring screw 106).

Aspect B

According to another aspect, the developer conveyors such as the supply screw 105 and the stirring screw 106 are made of resin.

This aspect obviates use of a metal conveying screw to make the sliding friction between the rotation shaft and the first end seal on the drive input side is smaller than the sliding friction between the rotation shaft and the second end seal on the second end side. Instead, a resin conveying screw can be used to save the cost.

Aspect C

According to another aspect, the upper developer conveyor is a supply screw (e.g., the supply screw 105) to supply the developer to the developer bearer (e.g., the developing roller 101), and the lower developer conveyor is a stirring screw (e.g., the stirring screw 106) to stir and charge supplied toner together with the developer.

With this configuration, the following effects are attained.

In the vertical biaxial developing device including the developer conveyors disposed one above another, the developer can be collected to the supply compartment 107 in which the supply screw 105 is disposed to perform preferable image developing.

Aspect D

According to another aspect, the developer conveyance speed of the stirring screw 106 is made faster than the developer conveyance speed of the supply screw 105.

With this configuration, the following effects are attained.

In the developing device employing vertical biaxial-circulation, on the front side F, the developer is pushed up from the lower developer conveyor (the stirring screw 106) to the upper developer conveyor (the supply screw 105), against the gravity, through a developer lifting opening (e.g., the first communicating portion 110*a*). Accordingly, when the developer conveyance speed of the stirring screw 106 is faster, the developer can be efficiently collected to the supply screw 105 (the supply compartment 107).

Additionally, by collecting the developer to the side of the developer lifting opening (e.g., the first communicating portion 110*a*) on the second end side, the sealing performance of the first end seal on the opposite side (the drive input side, on which the temperature tends to rise) can be reduced.

Aspect E

In one aspect of this disclosure, the first end seal on the drive input side (the input gear 114 side) is a brush seal (e.g., the brush seal 112*b*) made of, for example, pile fabric.

With this configuration, the following effects are attained.

This structure can reduce the amount of heat generated on the beating on the drive input side compared with the case where the seal 112.*a* made of resin is used on the drive input side.

Aspect F

In one aspect of this disclosure, a magnetic seal (e.g., the magnetic seal 122) is disposed on a center-facing side of at least one of the first end seals (e.g., the brush seal 112*b*) on the drive input side. The magnetic seal is disposed on a side of the first end seal facing the center side in the longitudinal direction of the developer conveyors (conveying screws).

With this configuration, the following effects are attained.

The heating amount on the first end seal on the drive input side is reduced by using the brush seal 112*b* compared with the heating amount on the other side where the developer lifting opening (the first communicating portion 110*a*) is located. When the magnetic seal 122 is disposed on the side of the second end seal facing the center side in the longitudinal direction of the conveying screw, the carrier in the developer forms the curtain 123 there.

The curtain 123 of carrier inhibits the developer from entering the portion sealed by the first end seal (e.g., the brush seal 112*b*) on the drive input side on which the heating amount is reduced. Thus, the sealing performance improves.

Aspect G

In another aspect, the casing the casing 5A) of the developing device (including the supply compartment 107 and the stirring compartment 108) includes a sac-shaped portion (e.g., the rear end portion 120) to support the first end portion of the rotation shaft of the lower developer conveyor (e.g., the stirring screw 106) on the drive input side.

With this configuration, the following effects are attained.

Since the developer does not leak outside the casing from the end of the lower developer conveyor (the stirring screw 106) on the drive input side, the sealing performance of the seal on the first end side (the drive input side) of the lower developer conveyor can be lowered.

Aspect H

In one aspect of this disclosure, the input gear 114 is an idler gear.

With this configuration, the following effects are attained.

When the input gear 114, which is susceptible to the heat from the body 200 of the image forming apparatus, is an idler gear, the amount of heat transmitted to the rotation shaft (e.g., the shaft 105A or 106A) of one of the conveying screws is reduced to suppress the temperature rise in the bearing portions (the bearings 111).

Aspect I

Further, according to an aspect of this disclosure, the developing device 5 and at least one of the image bearer (e.g., the photoconductor 1) to bear a latent image, a charger (e.g., the charging device 3), and a cleaning device (e.g., the photoconductor cleaning device 2) to clean the image bearer are housed in a common unit casing and formed as a process cartridge to be removably installed in the body of the image forming apparatus. For example, the image forming device 20 in FIG. 2 can be a process cartridge.

With this configuration, the process cartridge can attain the effects similar to those described above.

Aspect J

An image forming apparatus (e.g., the image forming apparatus 500) includes an image bearer (e.g., the photoconductor 1) to bear a latent image; and the developing device to develop the latent image with the developer. The image forming apparatus further includes the charger to charge the image bearer and the cleaning device to clean the image bearer, and the developing device and at least one of the image bearer, the charger, and the cleaning device are united into a process cartridge.

With this configuration, the image forming apparatus can attain the effects similar to those described above.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a casing to contain developer;

a developer bearer to convey the developer to a developing range opposing an image bearer;

an upper developer conveyor and a lower developer conveyor disposed below the upper developer conveyor, each of the upper developer conveyor and the lower developer conveyor having a rotation shaft and configured to convey the developer to one side in an axial direction of the rotation shaft;

an input gear disposed on a first end side of the developing device in the axial direction, to input a driving force to the developing device;

a communicating portion, disposed on the first end side, that guides the developer to fall from the upper developer conveyor to the lower developer conveyor;

bearings to receive end portions of the rotation shafts of the upper developer conveyor and the lower developer conveyor; and first end seals and second end seals to seal gaps in the bearings on the rotation shafts of the upper developer conveyor and the lower developer conveyor, respectively, the first end seals disposed on the first end side, the second end seals disposed on a second end side of the developing device opposite the first end side, wherein a sliding friction between the rotation shaft and at least one of the first end seals is smaller than a sliding friction between the rotation shafts and the second end seals, wherein the upper developer conveyor is configured to convey the developer toward the first end side on which the input gear is disposed, and the lower developer conveyor is configured to convey the developer toward the second end side in a direction away from the input gear.

2. The developing device according to claim 1, wherein the upper developer conveyor and the lower developer conveyor are made of resin.

3. The developing device according to claim 1, wherein the upper developer conveyor is a supply screw to supply the developer to the developer bearer, and wherein the lower developer conveyor is a stirring screw to stir and charge supplied toner together with the developer.

4. The developing device according to claim 3, wherein a developer conveyance speed of the stirring screw is faster than a developer conveyance speed of the supply screw.

5. The developing device according to claim 1, wherein the at least one of the first end seals is a brush seal made of pile fabric.

6. The developing device according to claim 1, further comprising a magnetic seal disposed on a center-facing side of the at least one of the first end seals on the first end side, the center-facing side facing a center side in the axial direction of the rotation shaft.

7. The developing device according to claim 1, wherein the casing of the developing device includes a sac-shaped portion to support the end portion of the rotation shaft of the lower developer conveyor on the first end side.

8. The developing device according to claim 1, wherein the input gear is an idler gear and receives the driving force from an image forming apparatus.

9. A process cartridge to be removably mounted in an image forming apparatus, the process cartridge comprising:

the developing device according to claim 1; and at least one of the image bearer to bear an electrostatic latent image developed by the developing device, a charger to charge the image bearer, and a cleaning device to clean the image bearer.

10. An image forming apparatus comprising:

the image bearer to bear an electrostatic latent image; and the developing device according to claim 1 to develop the electrostatic latent image with the developer.

11. The image forming apparatus according to claim 10, further comprising:

a charger to charge the image bearer; and a cleaning device to clean the image bearer, wherein the developing device and at least one of the image bearer, the charger, and the cleaning device are united into a process cartridge.

* * * * *